US006320561B1

(12) United States Patent
Arimoto et al.

(10) Patent No.: US 6,320,561 B1
(45) Date of Patent: Nov. 20, 2001

(54) DRIVE CIRCUIT FOR DISPLAY PANEL

(75) Inventors: Hironobu Arimoto; Atsushi Ito, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/261,260

(22) Filed: Mar. 3, 1999

(30) Foreign Application Priority Data

Sep. 30, 1998 (JP) ..... 10-276735

(51) Int. Cl.[7] ..... G09G 3/28

(52) U.S. Cl. ..... 345/60; 345/66; 345/68; 345/210; 345/214

(58) Field of Search ..... 345/60, 66, 68

(56) References Cited

U.S. PATENT DOCUMENTS

| | | | | |
|---|---|---|---|---|
| 5,446,344 | | 8/1995 | Kanazawa . | |
| 5,483,252 | * | 1/1996 | Shigeta et al. | 345/67 |
| 5,982,344 | * | 11/1999 | Tokunaga | 345/67 |
| 6,037,916 | * | 3/2000 | Amemiya | 345/60 |
| 6,054,970 | * | 4/2000 | Hirakawa et al. | 345/60 |
| 6,169,527 | * | 1/2001 | Kanazawa et al. | 345/60 |
| 6,181,305 | * | 1/2001 | Nguyen et al. | 345/60 |
| 6,243,084 | * | 6/2001 | Nagai | 345/210 |
| 6,252,568 | * | 6/2001 | Iseki et al. | 345/60 |
| 6,256,001 | * | 7/2001 | Kim et al. | 345/60 |

FOREIGN PATENT DOCUMENTS

| | | |
|---|---|---|
| 0615221 | 9/1994 | (EP) . |
| 0829846 | 3/1998 | (EP) . |
| 0836171 | 4/1998 | (EP) . |
| 2755785 | 5/1998 | (FR) . |
| 9325736 | 12/1967 | (JP) . |
| 7140927 | 6/1995 | (JP) . |
| 8212930 | 8/1996 | (JP) . |
| 8278766 | 10/1996 | (JP) . |
| 10143108 | 5/1998 | (JP) . |
| 9844531 | 10/1998 | (WO) . |

* cited by examiner

*Primary Examiner*—Almis R. Jankus
*Assistant Examiner*—Henry N. Tran
(74) *Attorney, Agent, or Firm*—Rothwell, Figg, Ernst & Manbeck

(57) ABSTRACT

In a display panel drive circuit, discharge is caused by applying a positive display pulse to a common electrode. The discharge is inhibited by applying a positive control voltage to the individual electrodes. Applying an opposite polarity pulse to the common electrode erases any charge remaining after an unstable discharge and effectively prevents unstable discharges.

4 Claims, 10 Drawing Sheets

DRIVE CIRCUIT FOR DISPLAY PANEL

BACKGROUND OF THE INVENTION

1. Field of the Invention

This invention relates to a drive circuit for a display panel, disposed with a common electrode and an individual electrode in each of a plurality of display cells arranged in a matrix configuration, for controlling gas discharges in each display cell by applying display pulses to a common electrode to perform display operations and by individually applying control voltages to individual electrodes to control the discharge in each display cell.

2. Description of the Related Art

Heretofore, display panels, such as plasma displays, are known for performing display operations by controlling the gas discharge of each display cell. In such display panels, it is necessary to continually maintain a favorable state for discharge of the stored charge in order to perform normal discharge. Accordingly, initialization is performed periodically in all display cells, such as by erasing the stored charge that causes discharge.

Japanese Patent Laid-Open Publication Nos. Hei 10-143106(1998/05/29), 8-278766(1996/10/22), 7-40927 (1995/06/02), 9-325736(1997/12/16), and 8-212930(1996/08/20) disclose this sort of initialization.

Although various types of initialization methods have been proposed in this manner, if the discharge conditions change, for example, a different method must be adopted.

RELATED APPLICATION

The present applicant has proposed an invention concerning a display panel with a novel drive method in an international application (application number PCT/JP98/01444) of the Patent Cooperation Treaty. This display panel comprises individual display cell electrodes and a common electrode. The individual electrodes are driven individually for every display cell and the common electrodes are driven together for a plurality of display cells. The discharge is then controlled for each display cell so as to control the overall display by applying a positive display pulse to the common electrode and by individually controlling the application of a positive control voltage to the individual electrodes.

The drive for the common electrode in this display panel employs display pulses having voltage that changes in two levels. One two-level display pulse performs discharge for storing charge and discharge for erasing charge. Theoretically, therefore, erasure of the charge is performed automatically, even though display discharge is repeated. However, storage of the charge due to insufficient voltage application when the power is turned on or storage of charge due to repetition of discharges does occur. In order to eliminate this, a positive pulse (initialization pulse) is supplied, once per frame, to all individual electrodes so as to invert the display cell charges to perform initialization.

This sort of initialization can solve the problem of inappropriate charge storage and maintain normal discharge. However, this method requires that a-sufficiently large positive voltage be applied to the individual electrodes. The voltage application onto the individual electrodes drives a control element (ex. transistor) corresponding to each display cell. Thus, the entire drive circuitry for the individual electrodes must be adapted for high voltages. Furthermore, the insertion of initialization pulses raises the frequency for driving the individual electrodes, resulting in the problem that the power consumption of the drive circuitry is increased.

SUMMARY OF THE INVENTION

The object of this invention is to solve the above-mentioned problems by providing display panel drive circuit capable of driving the individual electrodes at low voltages and low frequencies.

The display panel drive circuit of this invention applies a reset pulse having a polarity opposite to that of the display pulse in gaps between applied display pulses to the common electrode. Thus, the control of the individual electrode is unaffected even if reset pulses are inserted. Accordingly, it is sufficient to have one on-off operation of the individual electrode in one frame necessary to determine when to halt the discharge. Therefore, the individual electrode can be driven at a low frequency so as to achieve a reduction in power consumption of this drive circuit. Furthermore, a high voltage initialization pulse (reset pulse) for the individual electrode is unnecessary, making it possible to eliminate the need for handling high voltages in the drive circuit for the individual electrode.

The above-mentioned display pulse is formed from voltages of two levels and the voltage rises and lowers in a stepwise fashion. It is preferable for the absolute voltage value of the above-mentioned reset pulse to be greater than or equal to the first level voltage value of the display pulse. With this type of display pulse, one display pulse can cause two discharges, one for storing charge and another for erasing the stored charge. When a stable discharge is performed, the insertion of the reset pulse becomes unnecessary.

It may also be preferable to apply the above-mentioned reset pulse either once for one frame or once for a plurality of frames. This enables frames to be created without inserting the reset pulse and results in reduced processing requirements.

It may also be preferable to provide a sequence memory for storing a plurality of sequences for driving the above-mentioned common electrode and individual electrode, and to control the drive of the common electrode on the basis of the sequence data read out from the sequence memory. This enables repetitive output of the same display pulse to be easily performed.

Furthermore, it may be preferable to provide a loop memory for storing the sequence readout order from the above-mentioned sequence memory, and to read out the sequence data from the sequence memory on the basis of the data read out from the loop memory. This raises the degree of freedom of sequence use and permits various types of drive with a small storage capacity. In particular, the operation of the sequence of insertion of the reset pulse through the loop memory can be performed as desired.

This invention is composed as described above and achieves the effects given below.

(i) Control of the individual electrode remains unaffected, even if a reset pulse is inserted, because the reset pulse having a polarity opposite to that of the display pulse is applied in the interval between applied display pulses to the common electrode. Accordingly, one on-off operation of the individual electrode in one frame is sufficient to determine when to halt the discharge. Therefore, it is sufficient to drive the individual electrode at an extremely low frequency so as to achieve a reduction in power consumption of this drive circuit. Furthermore, a high voltage initialization pulse for the individual electrode is unnecessary, making it possible to lower the load in the drive circuit for the individual electrode and sufficiently lower the voltages to be handled.

(ii) The above-mentioned display pulse is formed from voltages of two levels and the voltage rises and lowers in a stepwise fashion. It may be preferable for the absolute voltage value of the above-mentioned reset pulse to be greater than or equal to the first level voltage value of the display pulse. With this sort of display pulse, one display pulse can cause two discharges, one for storing charge and another for erasing the stored charge. When a stable discharge is performed, the insertion of the reset pulse becomes unnecessary.

(iii) It may be preferable to apply the above-mentioned reset pulse once for one frame or once for a plurality of frames. This enables frames to be created without inserting the reset pulse and results in lighter processing requirements.

(iv) It may be preferable to provide a sequence memory for storing a plurality of sequences for driving the above-mentioned common electrode and individual electrode, and to control the drive of the common electrode on the basis of the sequence data read out from the sequence memory. This enables the drive to repetitively output the same display pulse to be easily performed.

(v) It may be preferable to provide a loop memory for storing the sequence readout order from the above-mentioned sequence memory, and to read out the sequence data from the sequence memory on the basis of the data read out from the loop memory. This raises the degree of freedom of sequence use and permits various types of drive with a small storage capacity. In particular, the operation of the sequence of insertion of the reset pulse can be easily performed.

DETAILED DESCRIPTION OF THE PREFERRED EMBODIMENTS

Embodiment 1

Figure 1:
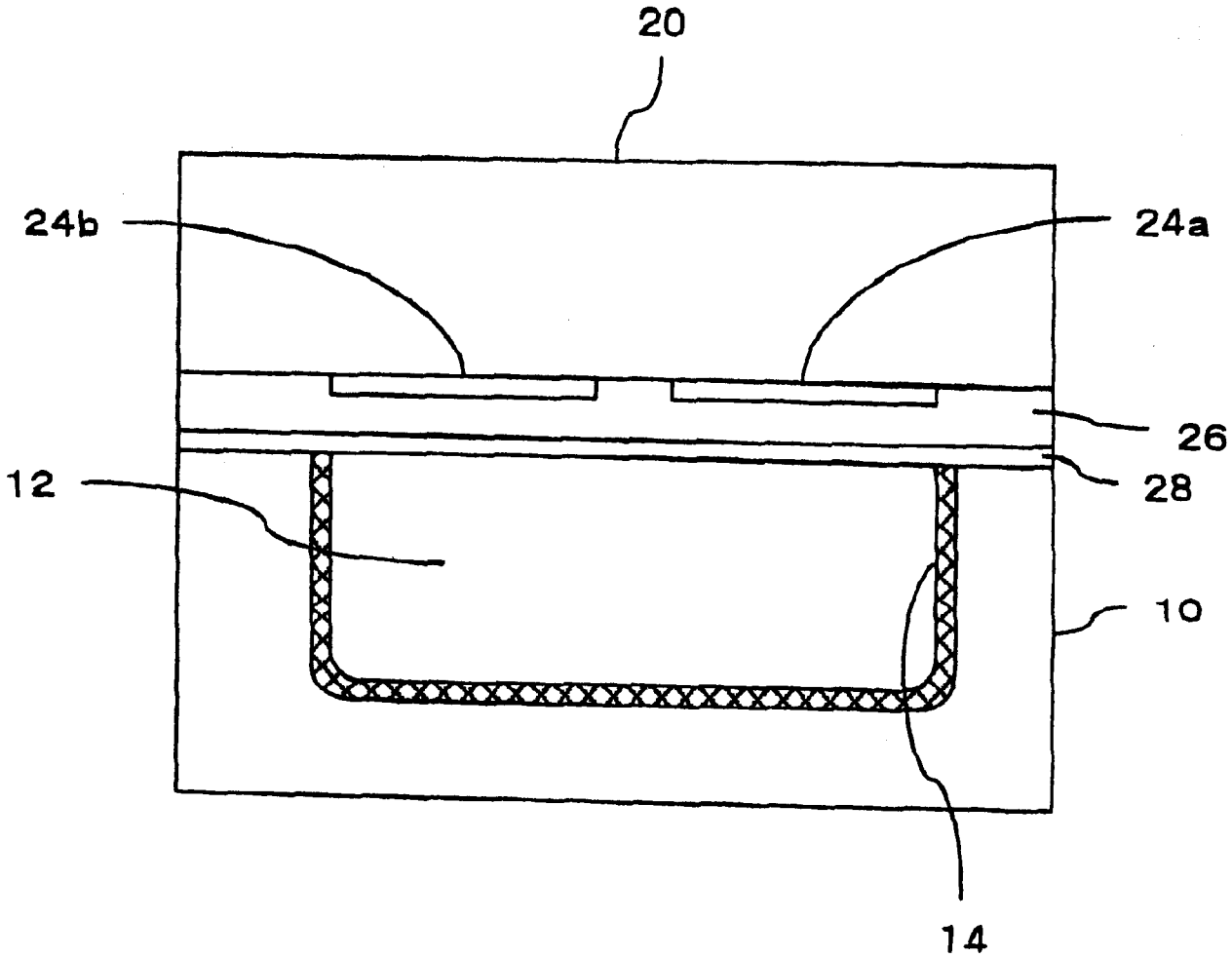
FIG. 1 illustrates the structure of a display cell to be driven by a drive circuit for display panel of the present invention.

FIG. 1 shows one display cell (one color) in a display panel of embodiment 1. On a rear of the display panel is provided a back glass plate 10. On the inner surface of a recess 12 formed in the back glass plate 10 is formed a fluorescent layer 14. On a back side (side facing the back glass plate 10) of a front glass plate 20 are disposed a pair of transparent electrodes 24*a* and 24*b*. So as to cover them, a dielectric layer 26 is formed, and a protective layer 28 is further formed. Therefore, the protective layer 28, which is usually formed from MgO, faces the recess 12. A positive display pulse is applied to a common-electrode and an individual electrode is maintained at a sufficiently low voltage (for example 0 V) so that a discharge occurs at a part close to the protective layer within the recess 12. A positive voltage is applied to the individual electrode so that the voltage value between the individual electrode and common electrode drops and the discharge ceases to occur.

Figure 2:
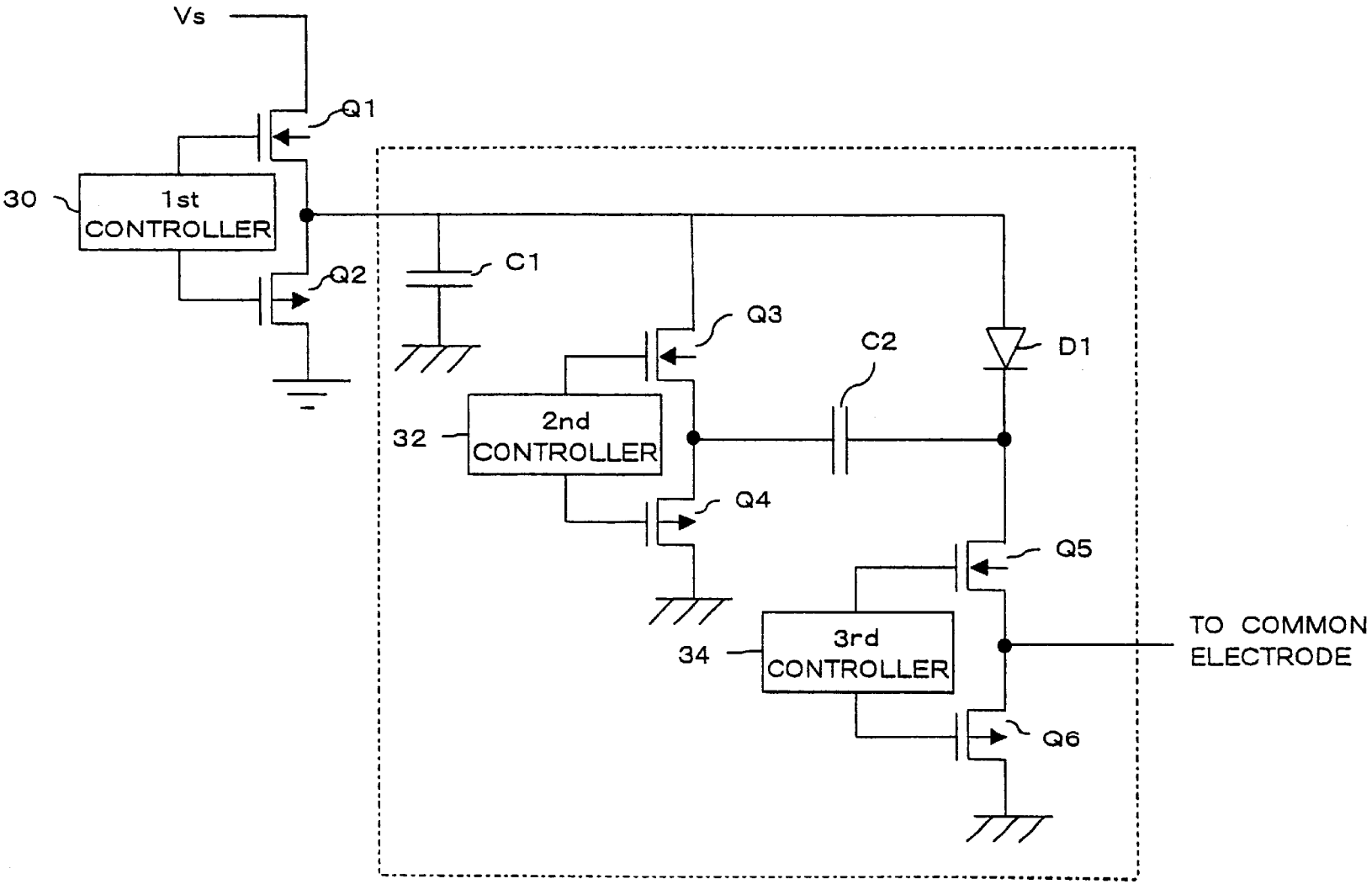
FIG. 2 illustrates the structure of the drive circuit for display panel concerning an embodiment of the present invention.

FIG. 2 shows a drive circuit for the common electrode. For example, a 160 V power supply Vs is grounded via transistors Q1 and Q2. The gates of transistors Q1 and Q2 are connected to a first controller 30. The on-off operations of transistors Q1 and Q2 are controlled by control signals from the first controller 30. By turning on transistor Q1 and turning off transistor Q2, a voltage Vs is output to a subsequent stage from a point (Vs output point) between transistors Q1 and Q2. The circuit of transistors Q1 and Q2, a circuit at the power supply side, is formed on a circuit board that is separate from the subsequent circuit denoted by the broken line in the figure and has a separate ground.

To the point between transistors Q1 and Q2 is connected a capacitor C1, which has its other end connected to ground. To the Vs output point are connected a transistor Q3 and a transistor Q4, which has its other end connected to ground. To the gates of transistors Q3 and Q4 is connected a second controller 32, which controls the on-off operations of the transistors Q3 and Q4. Furthermore, to the Vs output point are connected, via a diode D1, a transistor Q5 and a transistor Q6, which has its other end connected to ground. To the gates of transistors Q5 and Q6 is connected a third controller 34, which controls the on-off operations of the transistors Q5 and Q6.

Figure 3:
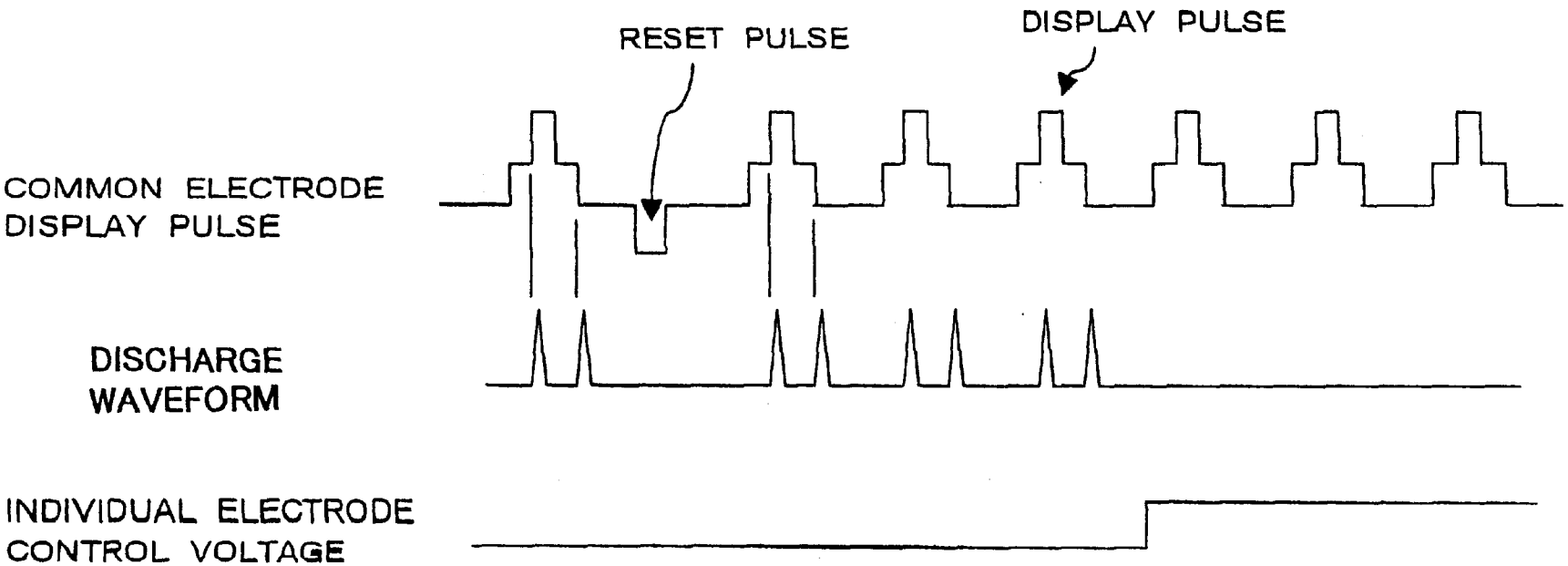
FIG. 3 shows a relationship between drive and discharge waveform in a stable state.

With transistor Q1 on and transistor Q2 off, transistors Q3, Q4, Q5, and Q6 turn on and off in the following manner so that a two-level display pulse shown in FIG. 3 is supplied to the common electrode.

TABLE 1

| | Q3 | Q4 | Q5 | Q6 |
|---|---|---|---|---|
| (1) At 0 V | OFF | ON | OFF | ON |
| (2) At first-level pulse rise | OFF | ON | OFF | OFF |
| (3) | OFF | ON | ON | OFF |
| (4) At second-level pulse rise | OFF | OFF | ON | OFF |
| (5) | ON | OFF | ON | OFF |
| (6) At second-level pulse fall | OFF | OFF | ON | ON |
| (7) | OFF | ON | ON | OFF |
| (8) At first-level pulse fall | OFF | ON | OFF | OFF |
| (9) | OFF | ON | OFF | ON |

Namely, by turning off transistor Q5 and turning on transistor Q6, the potential of the common electrode is at ground (0 V), and by turning on transistor Q5 and turning off transistor Q6, the potential of the common electrode reaches Vs. When Q4 is then turned on, a charge equivalent to Vs is stored into a capacitor C2. Then, by turning off transistor Q4 and turning on Q3, the transistor Q3 side of the capacitor C2 is Vs. Since the capacitor C2 is charged with Vs, the voltage at the common electrode becomes 2Vs. In this manner, voltages of two levels, Vs and 2Vs, can be generated. The voltage of the common electrode returns to Vs by turning off transistor Q3 off and turning on Q4, and the voltage of the supply electrode returns to 0 with transistor Q5 off and Q6 on so that a two-level display pulse can be formed.

Next, with Q5 off and Q6 on, transistor Q1 is turned off and Q2 is turned on. This causes the potential of the upper side of capacitor C1 to be fixed at the ground potential of 0 V on the power supply side. The ground on the lower side of capacitor C1 serves as the ground of the drive circuit and is not necessarily 0 V. This ground becomes −Vs, and the potential at the common electrode, which is connected to ground via transistor Q6, becomes −Vs. This causes the reset pulse in FIG. 3 to be applied to the common electrode.

This reset pulse has a polarity opposite to that of the display pulse and a magnitude of Vs that is identical to the first level pulse. This Vs is, for example, 160 V (approximately 150 V to 200 V) and is a voltage at which discharge occurs when a wall charge remains. Therefore, the application of this reset pulse causes discharge to occur when the wall charge remains so that the wall charge erases.

Figure 4:
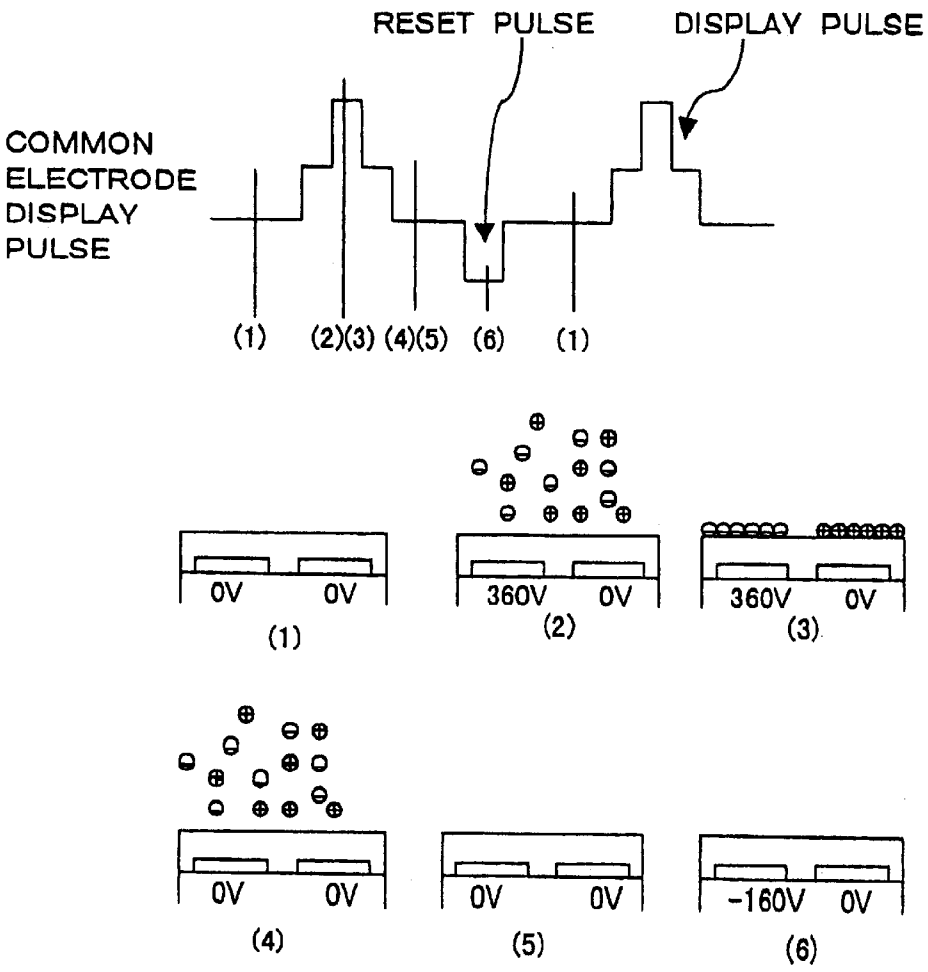
FIG. 4 shows a state of discharge in the stable state.
Figure 5:
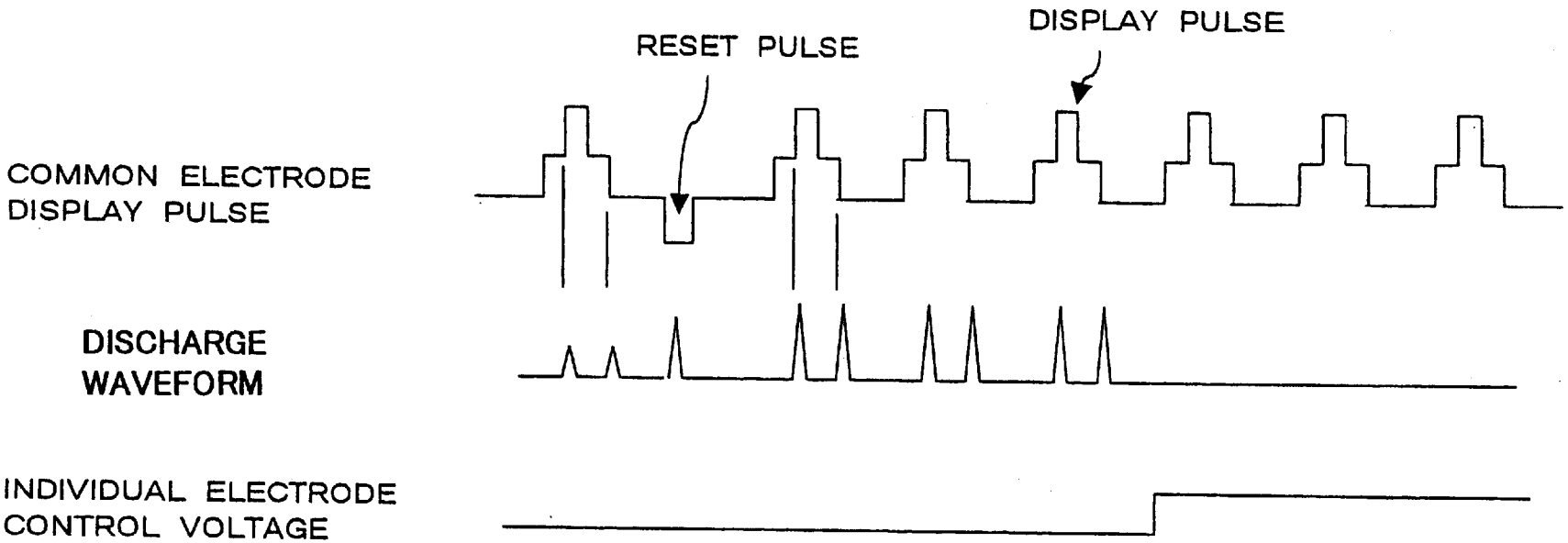
FIG. 5 shows a relationship between drive and discharge waveform in an unstable state.
Figure 6:
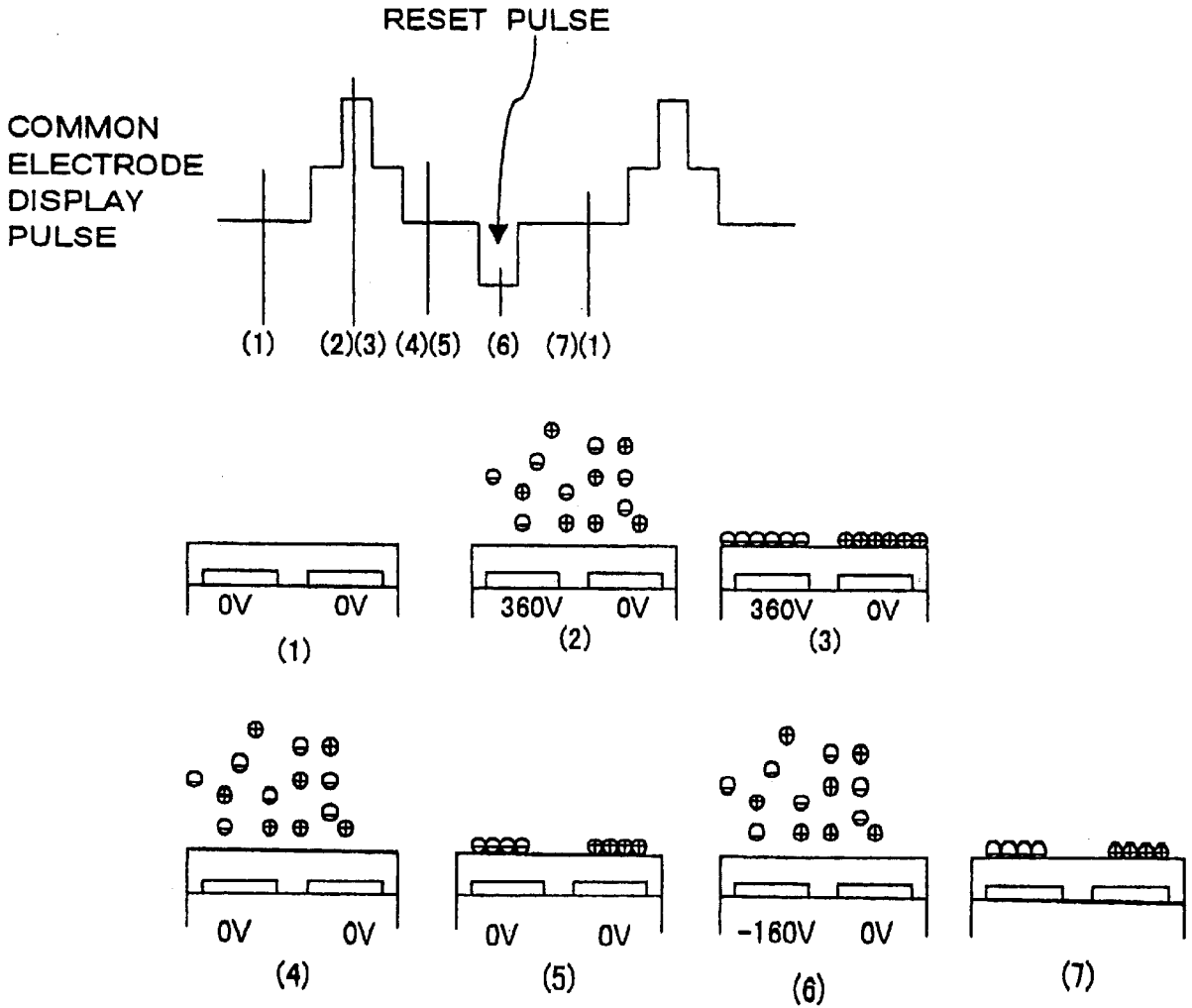
FIG. 6 shows a state of discharge in the un stable state.

FIGS. 3 to 6 illustrate the relationship of the applied voltages to the common electrode and individual electrode and the discharge. FIGS. 3 and 4 show the states of normal discharges and FIGS. 5 and 6 show the states during unstable discharges with wall charges remaining. When the unstable discharge occurs and wall charges remain as shown, the reset pulse causes discharge to occur, and thereby erase the wall charges.

As described above, it is preferable for the erase pulse to have a voltage near the first level of the display pulse so that a reliable erasing discharge is performed when wall charges remain. Furthermore, if the voltages are identical, the drive circuit can be simplified.

In the case where wall charges remain after discharge, it is necessary for the reset pulse to have a duration during which discharge can be reliably performed. In order to reliably perform discharge, a duration of about 5 μsec is necessary in this embodiment. This duration is affected by the size of the display cell and so forth. The time for this discharge is identical to that for the discharge by the display pulse and it is preferable to insert a reset pulse with a time of about 5 μsec after the elapse of about 15 μsec from the fall of the display pulse to 0 V (GND). If the display cell size changes, the discharge time changes so that both the above-mentioned values of 15 μsec and 5 μsec change. It is preferable for the time from the end of the display pulse to the start of the reset pulse and the duration of the reset pulse to have a relationship of around 3:1. It should be noted that this relationship applies to the case where minimum times are used for both values, and setting sufficient times for both values poses no problem.

Embodiment 2

Figure 7:
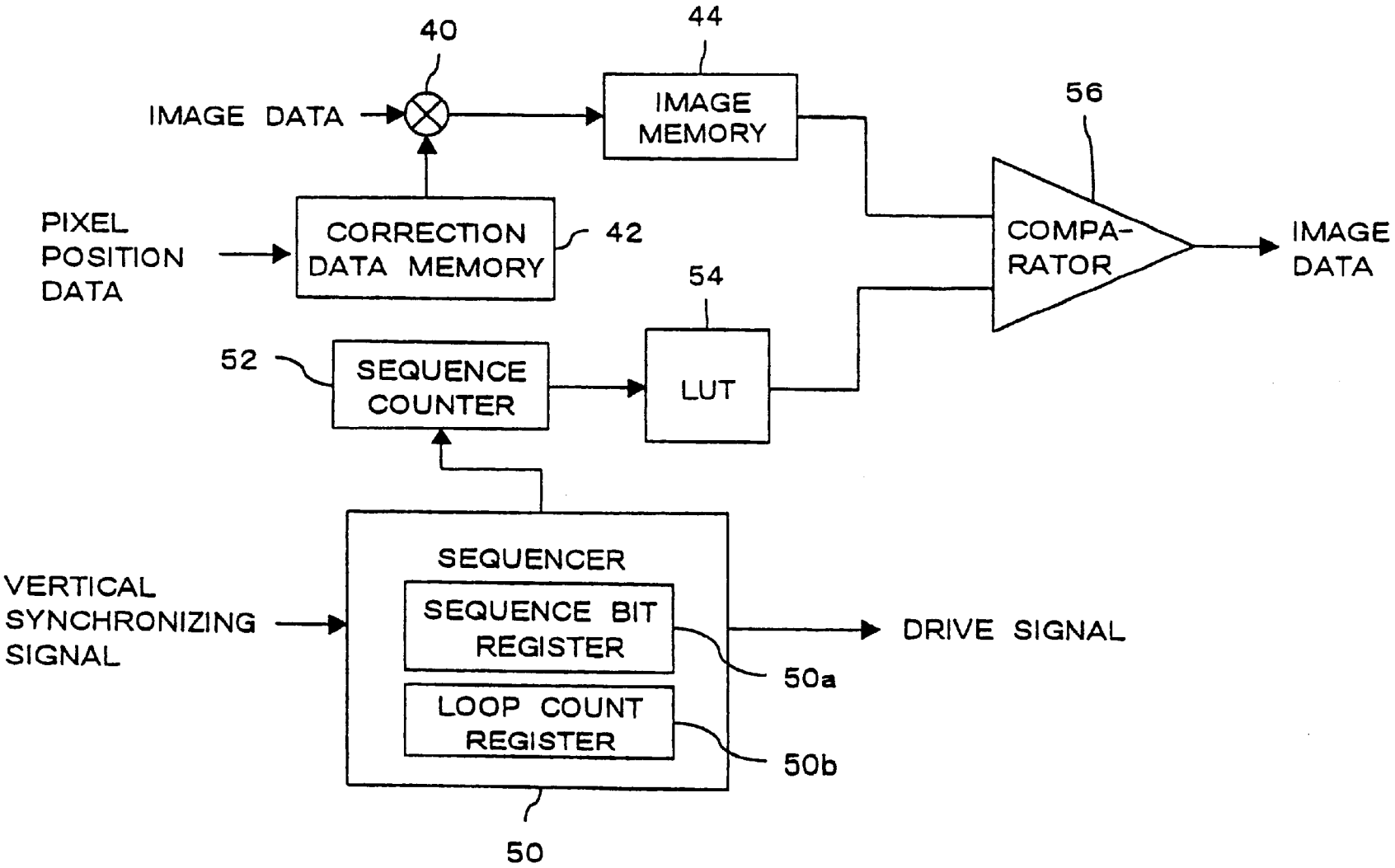
FIG. 7 shows the structure of the display control circuit.

FIG. 7 shows the structure of a display control circuit for controlling the drive of the individual electrode and common electrode. Image data, which is RGB digital data for every pixel, is input by a multiplier 40. In the display panel, one pixel comprises three RGB display cells. One RGB data item at a time causes the discharge of the corresponding display cell to be controlled. The description below is based on the case where a single luminance data value is input.

Correction data is supplied to the multiplier 40 from a correction memory 42, and correction is performed by multiplication of the image data and correction data. The correction memory 42 stores correction data for every display cell. The correction data corresponding to the image data is read from the correction memory 42 and multiplied on the basis of the image position data that is input to yield error-corrected image data for every cell. This allows variations in luminance of the display cells to be corrected. It should be noted that the corrections need not necessarily be performed by multiplication but may be performed by the addition of differential data. In this embodiment, the image data has 9 bits and the correction data has 8 bits. With a "1" added to the most significant bit of the correction data for a total of 9 bits, 9×9 multiplication is performed and the most significant 9 bits are output from the multiplier 40 as the calculation result.

The corrected image data, which is the output of the multiplier 40, is stored in an image memory 44. The image data for at least one frame is stored in the image memory 44. Usually, the image data for one frame at a time is stored for R, G, and B, respectively.

In the meantime, a sequencer 50 generates and outputs a drive signal for common electrode drive after detecting the start of one frame with a vertical synchronizing signal. The display pulse is repeated in one frame period and supplied to the common electrode. The sequencer 50 then supplies a pulse signal, which is synchronized to the display pulse, to a sequence counter 52. Thus, a count value in the sequence counter 52 is determined by the number of display pulse outputs. The luminance of the display cell corresponds to the number of discharges in one frame. Since the number of discharges corresponds to the number of display pulses, the count value becomes the assumed luminance (assumed luminance data) when light is emitted due to the display pulses.

The output of the sequence counter 52 is supplied to a lookup table (LUT) 54. A predetermined conversion is performed according to this lookup table 54 and the converted assumed luminance data is input by a comparator 56. To another input terminal of this comparator 56 is input the image data from the image memory 44. A one-bit signal is then obtained from the comparator 56 in order to control the supply of the control voltage to the individual electrode of the display cell.

One data item is output from the lookup table 54 for each display cell in the display of one frame display. For a color display, there are three types of RGB data for one display unit (pixel: three types (RGB) of data for one pixel) so the image data for one frame (three types of RGB data for three frame memories) is output in parallel from the image memory 44. The comparator 56 is provided for each color, and at each comparator 56, the image data for each display cell and the assumed luminance data from the lookup table 54 are compared. The comparison results are individually output from the comparators 56 one by one as display data of each display cell. Controlling the voltage applied to each individual electrode of each display cell by one frame of pixels×3 (RGB) items of display data controls the light emission in each display cell so that an image is displayed on the display panel.

For example, if the image data has 256 gradations and the number of pulses to be output from the sequencer 50 is 256 pulses, it is sufficient to cause the display cell to emit light by performing the discharge according to the display pulses until the output value of the sequence counter 52 is the same as the gradations of the image data. When the values that are input are identical at the comparator 56, it is sufficient to change the value of the display data and at this time to control the control voltage to be applied to the individual electrode so that the light emission ceases. In this embodiment, an arbitrary conversion can be performed for the assumed luminance data by means of the contents of the lookup table 54. Therefore, the light emission time can be set as desired in accordance with the gradations of the image data.

In this embodiment, the number of display pulse outputs in one frame is 765 pulses. If the lookup table 54 is set so that 0, 3, 6, 9 , . . . , 765 are output with respect to inputs 0, 1, 2, 3 , . . . , 255, one gradation corresponds to three discharges and both the input and output have a linear relationship.

In the meantime, if the amount of the increment or decrement is varied, such as if the value of the lookup table 54 is initially incremented by 1 and subsequently incremented by 5, the amount of light emission can be arbitrarily set according to the change in gradation. Thus, gamma correction can be achieved by settings of the content of the lookup table 54. Furthermore, through each of the RGB colors, the tint and so forth can be set by rewriting the contents of the lookup table 54.

Figure 8:
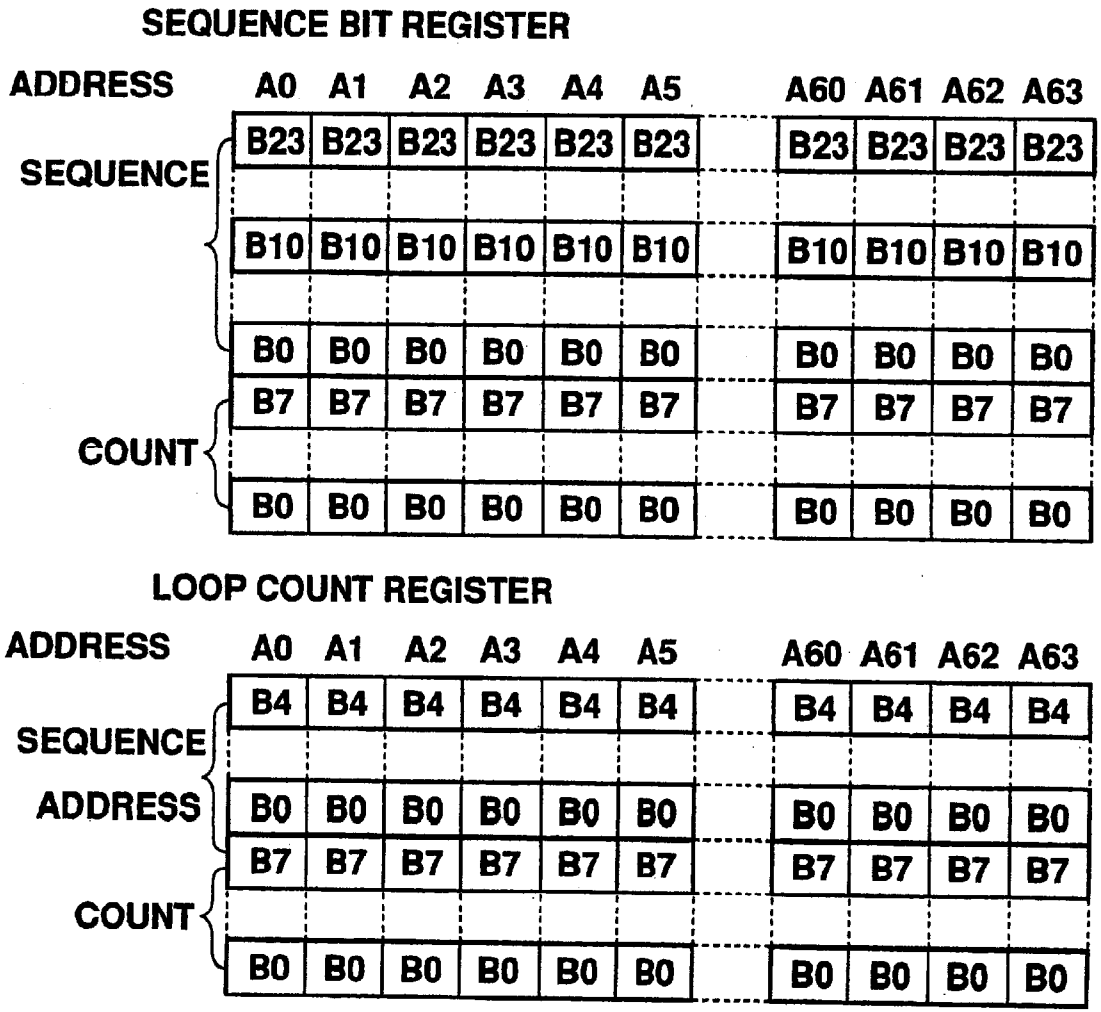
FIG. 8 show s the structure of a sequencer.

The operation of the sequencer 50 will next be described. The sequencer 50 internally contains a sequence bit register 50*a*, which is a sequence memory for storing a drive sequence internally, and a loop count register 50*b*, which is a loop memory for controlling a readout of sequences. Their structures are shown in FIG. 8.

The sequence bit register 50*a* stores the sequence (or pattern) for the drive signal and its period. Sequence bits B0 to B23 of each address A0 to A63 indicate values for output, and these values are, for example, commands for the drive voltage for the common electrode. Counter bits B0 to B7 indicate the output periods of the sequence bits. The counter bits can, for example be, the number of system clock pulse.

The loop count register 50*b* stores the address of the sequence bit register and the number of sequence outputs. Sequence address bits B0 to B4 of each address A0 to A63 indicate the address of the sequence bit register 50*a*, and the sequence output is performed according to this address setting. Furthermore, the counter bits B0 to B7 indicate the number of loops of the sequence to be performed at the specified address.

Figure 9:
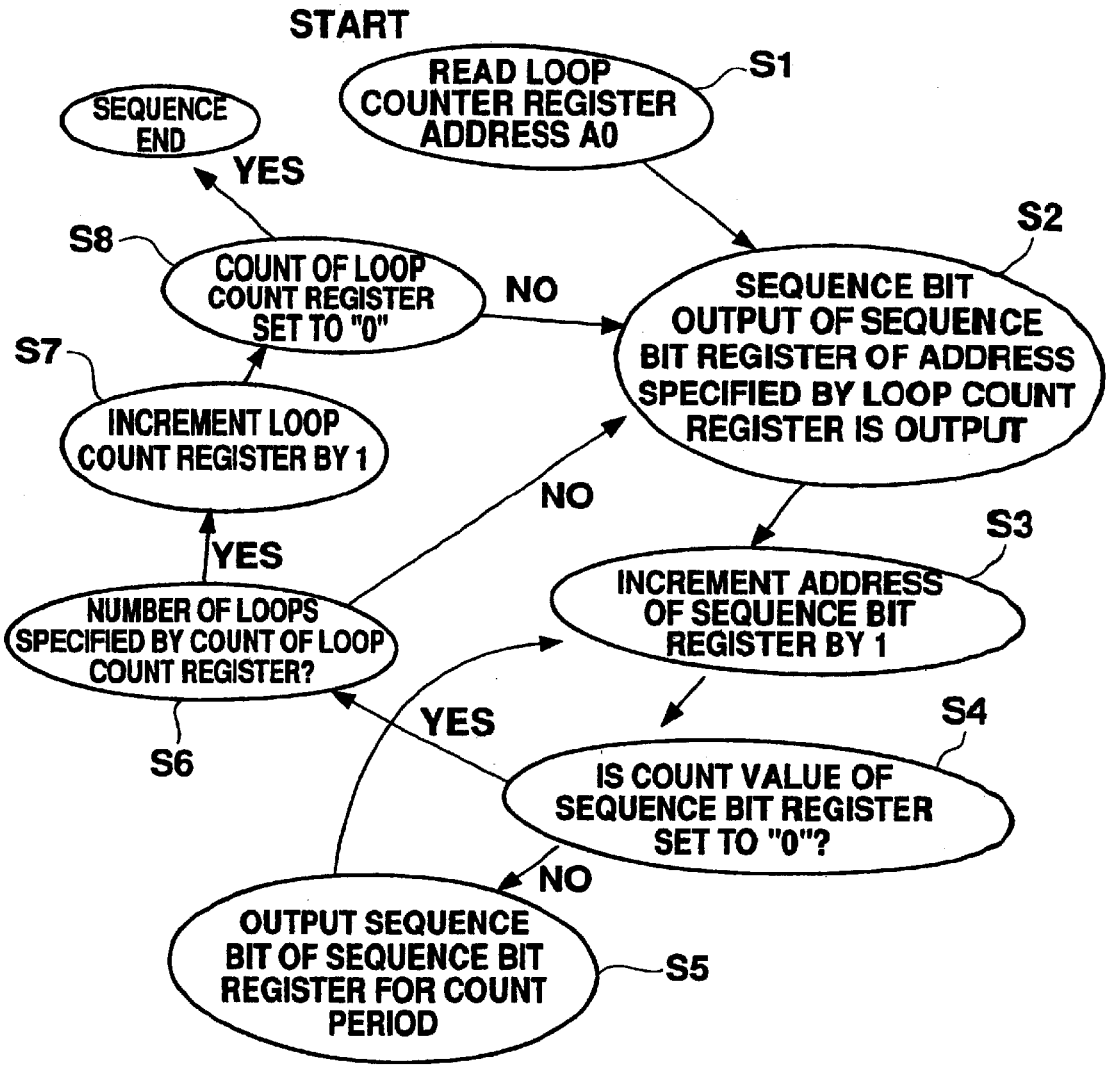
FIG. 9 shows the operation of the sequencer.

The operation at the sequencer 50 will be described here with reference to FIG. 9. The sequencer 50 first reads (S1) the top address A0 of the loop count register 50*b*. Next, the sequence bit of the sequence bit register 50*a* at the address specified by the sequence address of the loop count register is output for the period specified by the counter bit (S2). When the output of S2 terminates, the address of the sequence bit register 50*a* is incremented by 1 (A1 follows A0) (S3). It is then judged whether the count value of the sequence bit register 50*a* has been set to 0 (S4).

If the count value of the sequence register 50*a* is a specific value (in this case 0), the setting is made to signify the termination of the successive output of the sequence in the sequence register 50*a*.

If the result of the judgment in S4 is NO, the sequence bit of the next address (address in the previous process incremented by 1) of the sequence bit register 50*a* is output for the count period (S5). When this is terminated, the operation returns to S3, which increments the sequence bit register 50*a* by one. The output of the sequence stored in the sequence bit register 50*a* is repeated, and the output of the sequence in the sequence bit register 50*a* is repeated until the count value of the sequence bit register 50*a* reaches 0. A count value other than 0 signifies some type of output is to be performed while a count value of 0 signifies the output is not to be performed or that the sequence is to be terminated.

Then, when the count value of the sequence bit register 50*a* becomes 0 and the result of S4 is YES, the operation returns to the loop count register 50*b* where it is judged whether the specified number of loops of the count has been performed (S6). If the specified number of loops has not been performed, the operation returns to S2 where the sequence of the sequence bit register of the address specified by the loop count register 50*b* at the time is output.

In this manner, if the process specified by one address of the loop count register 50*b* terminates (termination of the specified number of loops of the count of the loop count register 50*b*) and the result of S6 is YES, the address of the loop count register 50*b* is incremented by 1 (S7). It is then judged whether the count value of the loop count register 50*b* is 0 (S8).

If the count value is 0, this signifies that the corresponding sequence is not to be performed. Therefore, not performing the output signifies the termination of the sequence so in this case the sequence is terminated. On the other hand, if the count value of the loop count register 50*b* is not 0, the operation returns to S2 and the sequence bit of the sequence bit register of the address specified by the loop count register 50*b* is output for the count period.

In this manner, the signal for controlling the output of the common pulse to the common electrode is output from the sequencer 50 so as to operate the drive circuit shown in FIG. 1. Controlling the voltage of the individual electrode on the basis of the display data in the period in which the output of this common pulse is performed enables the light emission of each display cell to be controlled.

In addition to the synchronization sequence for synchronizing to the vertical synchronizing signal to be executed every time in each frame so that the display pulse is applied onto the common electrode as a sequence, the sequencer 50 of this embodiment also contains an insertion sequence for inserting the reset pulse only into a predetermined frame. The execution of this insertion sequence is identical to the execution of the above-mentioned sequence, except that the output differs.

Figure 10:
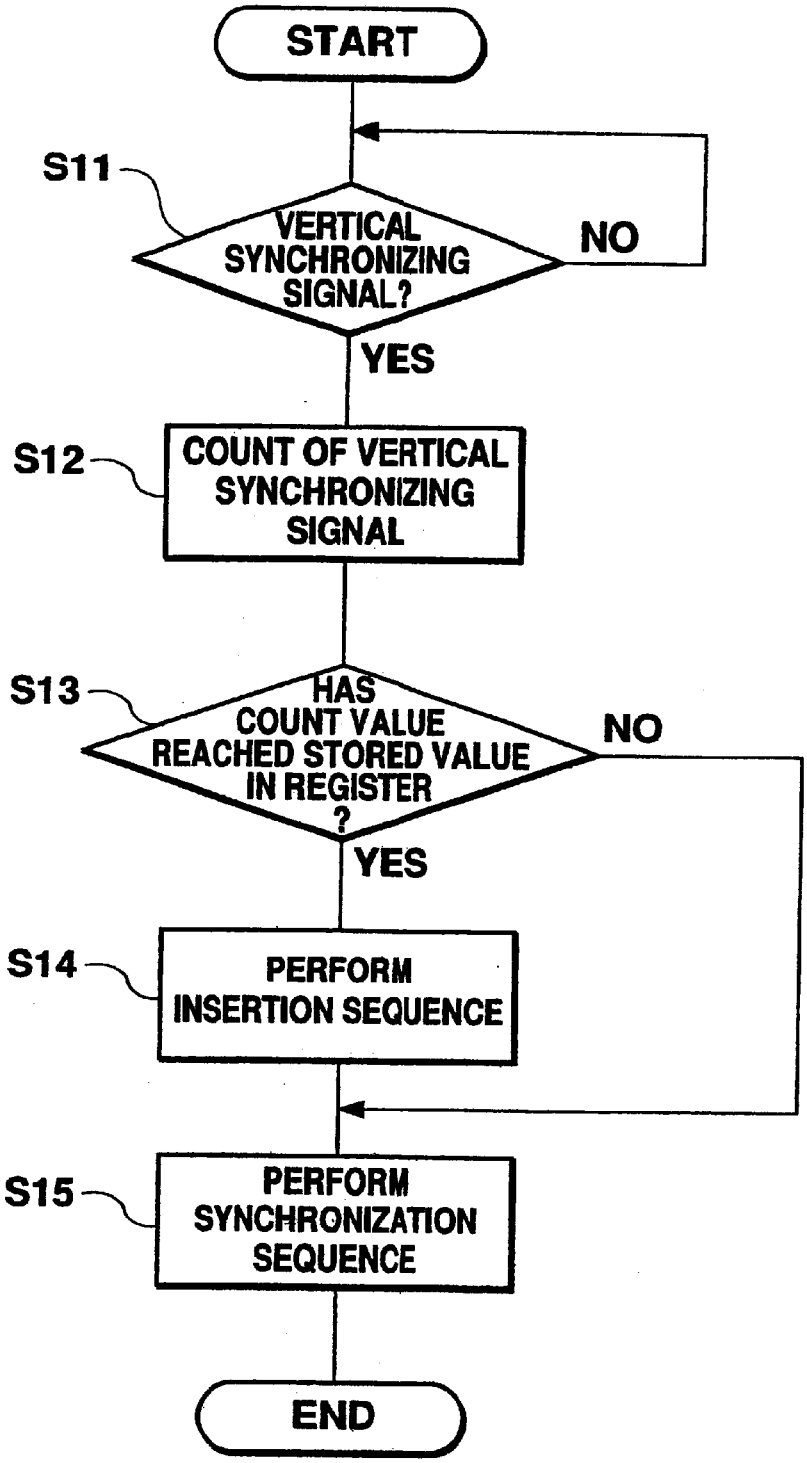
FIG. 10 shows the operation of an insertion sequence by the sequencer.

This insertion sequence is inserted before the actual display (discharge due to display pulses) begins. This is described with reference to FIG. 10. It is first judged whether the vertical synchronizing signal has arrived (S11). Although this vertical synchronizing signal indicates the termination of the vertical retrace period, it may also be judged as the start or middle of the vertical retrace period.

The vertical synchronizing signal is counted (S12) when it arrives. This is then compared with the value stored in the register (S13). For example, if this sequence is to be performed every three frames, a "3" is stored in the register. Then, if the count is greater than or equal to the stored value of the register, the insertion sequence is performed (S14).

If the operation of the insertion sequence terminates or if the count value in S13 has not reached the value stored in the register, the synchronization sequence is performed (Sl5). As a result, according to the value stored in the register, the sequence for the output of the reset pulse stored in the sequence bit register is read out at every predetermined frame, and the reset pulse is inserted. It is preferable to execute this insertion sequence prior to the start of the synchronization sequence that is to be performed each time.

Changing the stored value in the register enables the timing for the execution of the insertion sequence to be arbitrarily set, and enables the insertion sequence to be executed as desired in the sequencer 50.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A drive circuit for a display panel having an individual electrode in each of a plurality of display cells arranged in a matrix configuration together with a common electrode that is common to the plurality of display cells, for controlling gas discharges in each display cell by applying a display pulse to the common electrode to perform display operations and by individually applying control voltages to the individual electrodes to control the discharge in each display cell, wherein:

a reset pulse having a polarity opposite to that of the display pulse is applied in intervals between applied display pulses to the common electrode; and wherein said display pulse is formed from voltages of two levels, the voltages rising and falling in a stepwise fashion, with the absolute voltage value of said reset pulse greater than or equal to the first level voltage value of the display pulse.

2. The drive circuit of claim 1 wherein said reset pulse is applied once per frame or once per a plurality of frames.

3. The drive circuit of claim 1 further comprising:

a sequence memory for storing a plurality of sequences for driving said common electrode and said individual electrodes;

wherein driving of the common electrode is controlled on the basis of sequence data read out from the sequence memory.

4. The drive circuit of claim 3 further comprising:

a loop memory for storing a sequence readout order from said sequence memory;

wherein sequence data is read out from the sequence memory on the basis of the data read out from the loop memory.

* * * * *